US005560071A

United States Patent [19]

Chang

[11] Patent Number: 5,560,071

[45] Date of Patent: Oct. 1, 1996

[54] BELTLIKE BATH SCRUBBER

[76] Inventor: Che-Yuan Chang, No. 1, Lane 147, Sec. 2, Chung San Rd., Yun Lin, Chang Hua Hsien, Taiwan

[21] Appl. No.: 547,161

[22] Filed: Oct. 24, 1995

[51] Int. Cl.[6] ..... A47K 7/02

[52] U.S. Cl. ..... 15/222; 601/137; 601/138

[58] Field of Search ..... 15/222, 208, 209.1, 15/210.1, 211, 229.11, 229.12, 229.13, 229.14; 601/138, 137

[56] References Cited

U.S. PATENT DOCUMENTS

| | | | |
|---|---|---|---|
| 1,714,687 | 5/1929 | McKeag | 15/222 |
| 1,741,962 | 12/1929 | Theodoropulos | 15/222 |
| 2,737,679 | 3/1956 | Choma | 15/222 |
| 3,959,841 | 6/1976 | Horne | 15/222 |
| 3,977,796 | 8/1976 | Gillespie | 15/222 |
| 5,295,280 | 3/1994 | Hudson et al. . | |

FOREIGN PATENT DOCUMENTS

| | | | |
|---|---|---|---|
| 1029241 | 1/1989 | Japan | 15/222 |

*Primary Examiner*—Frankie L. Stinson
*Assistant Examiner*—Randall E. Chin
*Attorney, Agent, or Firm*—Browdy and Neimark

[57] ABSTRACT

A beltlike bath scrubber comprises a main body and two holding members disposed at both ends of the main body. The main body is composed of a plurality of cylindrical elastic nets having a pleated outer edge. Two adjacent elastic nets are connected in a parallel manner by a restraining member. The outer edges of the elastic nets are so expansible as to provide the user of the bath scrubber with a good scrubbing effect or sensation. The elastic nets may be connected in series to provide a good scrubbing effect.

5 Claims, 5 Drawing Sheets

BELTLIKE BATH SCRUBBER

FIELD OF THE INVENTION

The present invention relates generally to a cleaning tool, and more particularly to a beltlike bath scrubber having an excellent cleaning effect.

BACKGROUND OF THE INVENTION

The U.S. Pat. No. 5,295,280 discloses an extensible beltlike bath scrubber made up of a plurality of elastic cylindrical nets which are chained in series. Such a prior art scrubber as described above is defective in design in that only the outermost layers of the nets are in contact with the body skin of a bather, thereby compromising the scrubbing effect of the prior art scrubber. In addition, the prior art scrubber has a rather limited expansibility and does not provide its user with a sensational feeling when it is at work.

SUMMARY OF THE INVENTION

It is therefore the primary objective of the present invention to provide a beltlike bath scrubber which has irregular scrubbing surfaces capable of improving the scrubbing effect of the bath scrubber of the present invention.

It is another objective of the present invention to provide a beltlike bath scrubber having a considerable expansibility capable of providing its user with a scrubbing sensation when the bath scrubber is at work.

The foregoing objectives of the present invention are accomplished by a beltlike bath scrubber, which comprises a main body and two holding members disposed at both ends of the main body. The main body is composed of a plurality of elastic cylindrical nets having a pleated outer edge. Two adjacent elastic nets are connected in a parallel manner by a restraining member. The outer edges of the cylindrical nets are so expansible as to provide the user of the bath scrubber with a good scrubbing effect or sensation. The cylindrical nets may be connected in series to provide a good scrubbing effect.

DETAILED DESCRIPTION OF THE INVENTION

Figure 1:
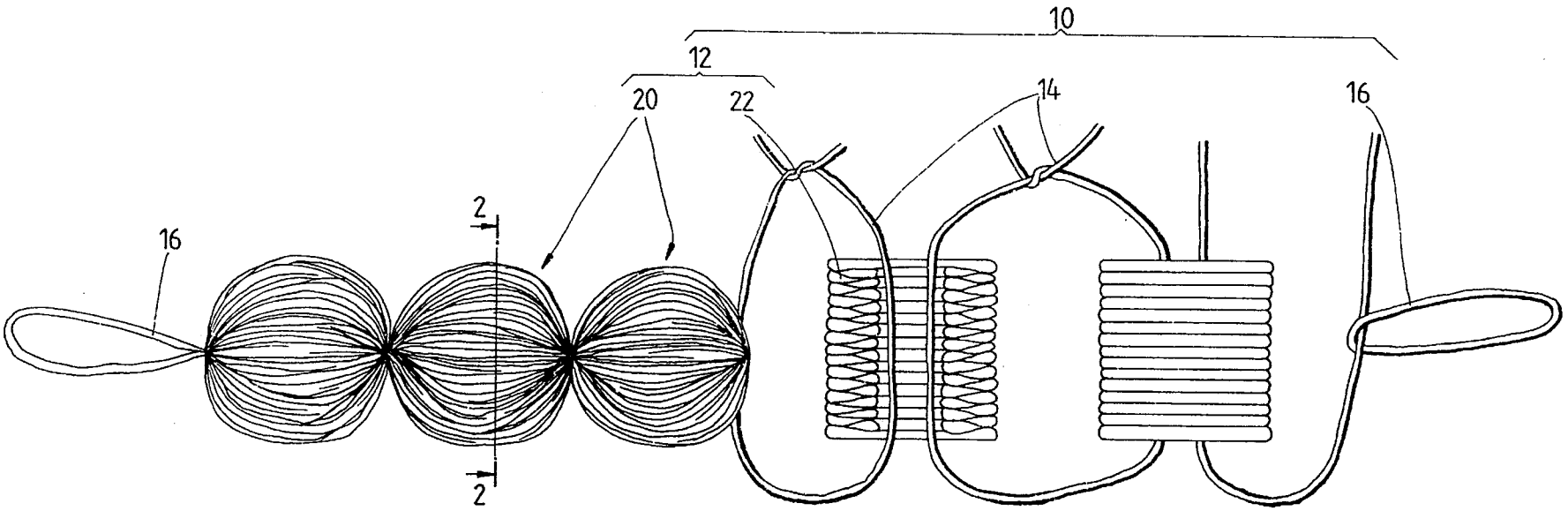
FIG. 1 shows an exploded view of a first preferred embodiment of the present invention.
Figure 2:
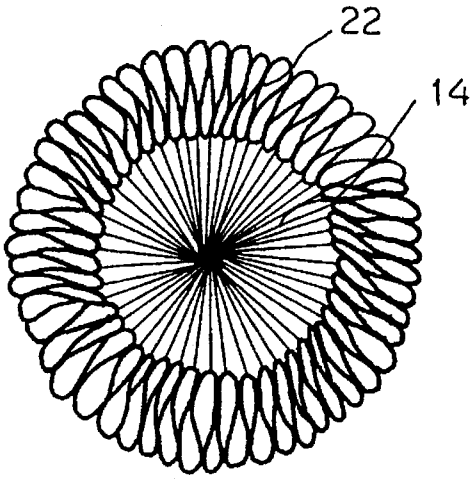
FIG. 2 shows a sectional view of a portion taken along the line 2—2 as shown in FIG. 1.

As shown in FIGS. 1 and 2, a beltlike scrubber 10 of the first preferred embodiment of the present invention is composed of a main body 12, a plurality of restraining members 14 and two holding members 16.

The main body 12 is made up of a plurality of unit members 20 which are fastened in a parallel manner. Each of the unit members 20 is composed of an elastic cylindrical net 22 having a pleated outer edge.

Each of the restraining members 14 is in fact a cord having an appropriate length and an appropriate strength. Two adjacent elastic nets 22 are restrained by the restraining member 14 such that the pleated outer edges of two elastic nets 22 are expanded on the restraining member 14 serving as an axis, so as to become spherical in shape, as shown in FIG. 2.

Each of two holding members 16 is in fact an elastic cord having a diameter greater than that of the restraining member 14. Two elastic nets 22 located at both ends of the main body 12 are fastened respectively with the holding member 16 to facilitate the holding of the beltlike scrubber 10 by a bather.

The beltlike scrubber 10 of the present invention has inherent advantages, which are expounded explicitly hereinafter.

The mesh orientations of the outer edges of the elastic nets 22 of the main body 12 become rather irregular at the time when the scrubber 10 of the present invention is at work, thereby bringing about a multidirectional scrubbing effect. In other words, the beltlike scrubber 10 of the present invention works better.

Each unit member 20 is so expanded as to become spherical, thereby bringing about a scrubbing comfort when the beltlike scrubber 10 of the present invention is at work.

Each unit segment of the beltlike scrubber 10 of the present invention has a length which is about equal to an inner diameter of each elastic net 22. As a result, the beltlike scrubber 10 of the present invention has a good expansibility along the longitudinal direction of the scrubber 10.

Figure 4:
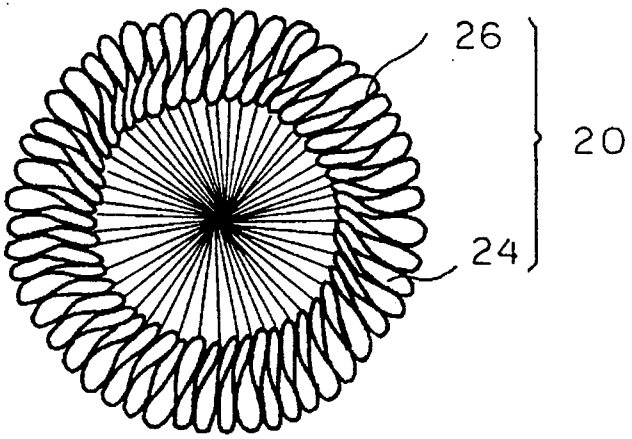
FIG. 4 shows a sectional view of a portion taken along the line 4—4 as shown in FIG. 3.
Figure 3:
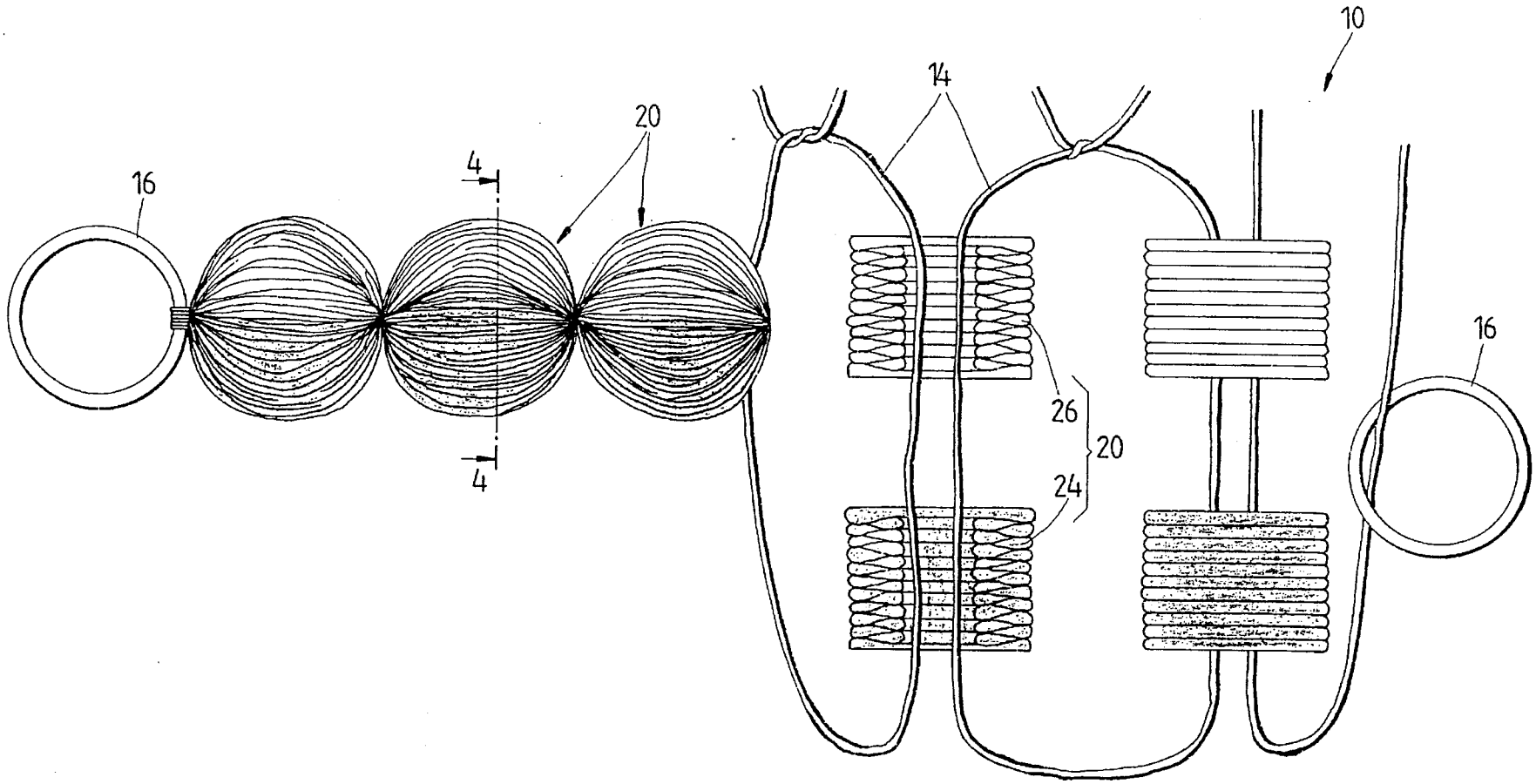
FIG. 3 shows an exploded view of a second preferred embodiment of the present invention.

As shown in FIGS. 3 and 4, the second preferred embodiment of the present invention comprises unit members 20, each of which is made up of two elastic nets 24 and 26 having different thread diameters, mesh sizes and surface textures. In addition, two elastic nets 24 and 26 are arranged in series to become an independent unit member 20. A plurality of unit members 20 are connected by the restraining members 14 in a parallel manner to form the main body 12.

The esthetic effect of the main body 12 can be further enhanced by the elastic nets 24 and 26 having different colors. In addition, the elastic nets 24 and 26 can bring about different frictional effects on the body skin of a bather.

Figure 5:
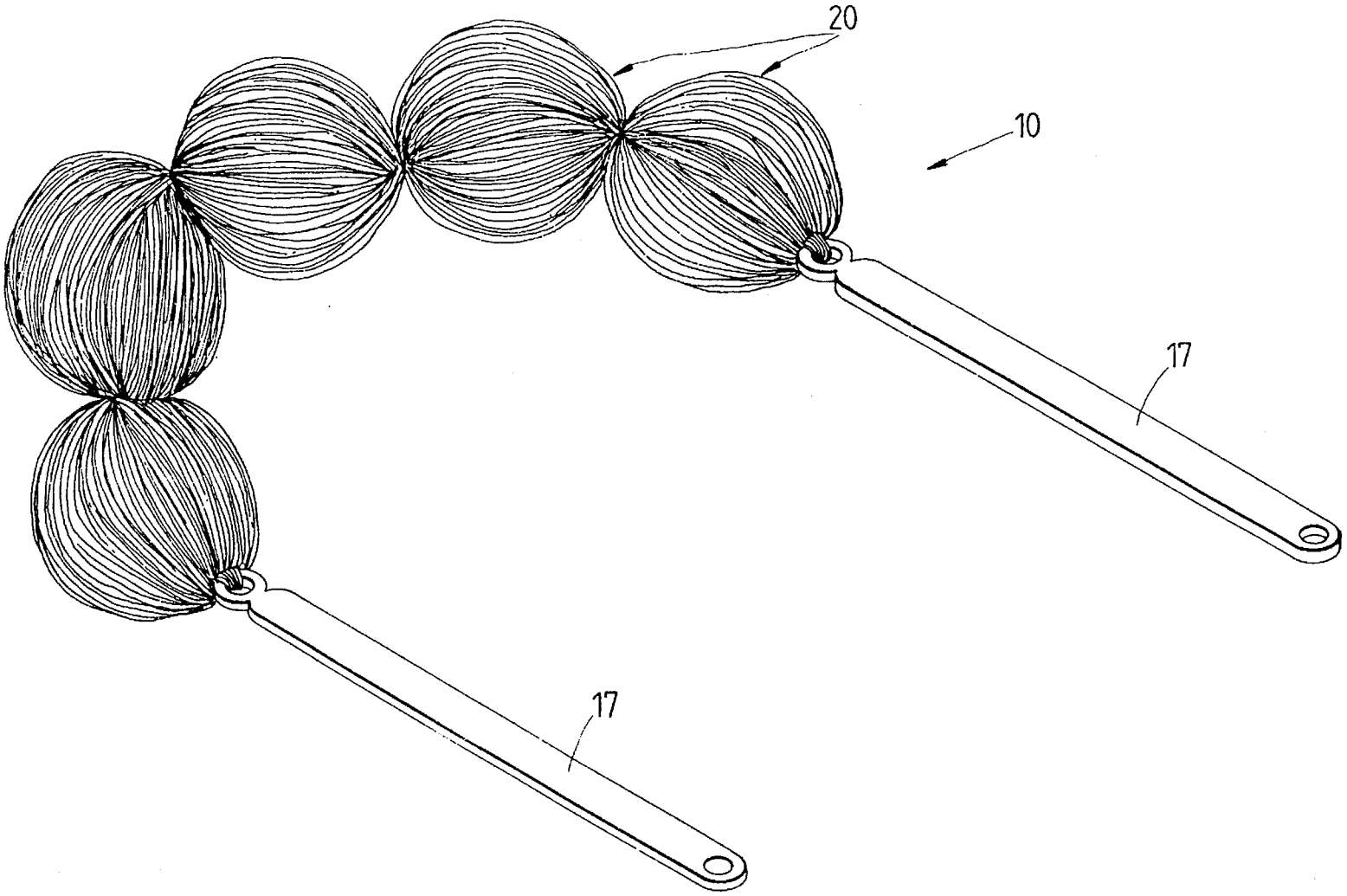
FIG. 5 shows a front view of a third preferred embodiment of the present invention.

The third preferred embodiment of the present invention is illustrated in FIG. 5 in which the beltlike scrubber 10 of the present invention is shown comprising two handles 17 replacing the holding members 16. The scrubber 10 can be used with one hand holding both handles 17.

Figure 6:
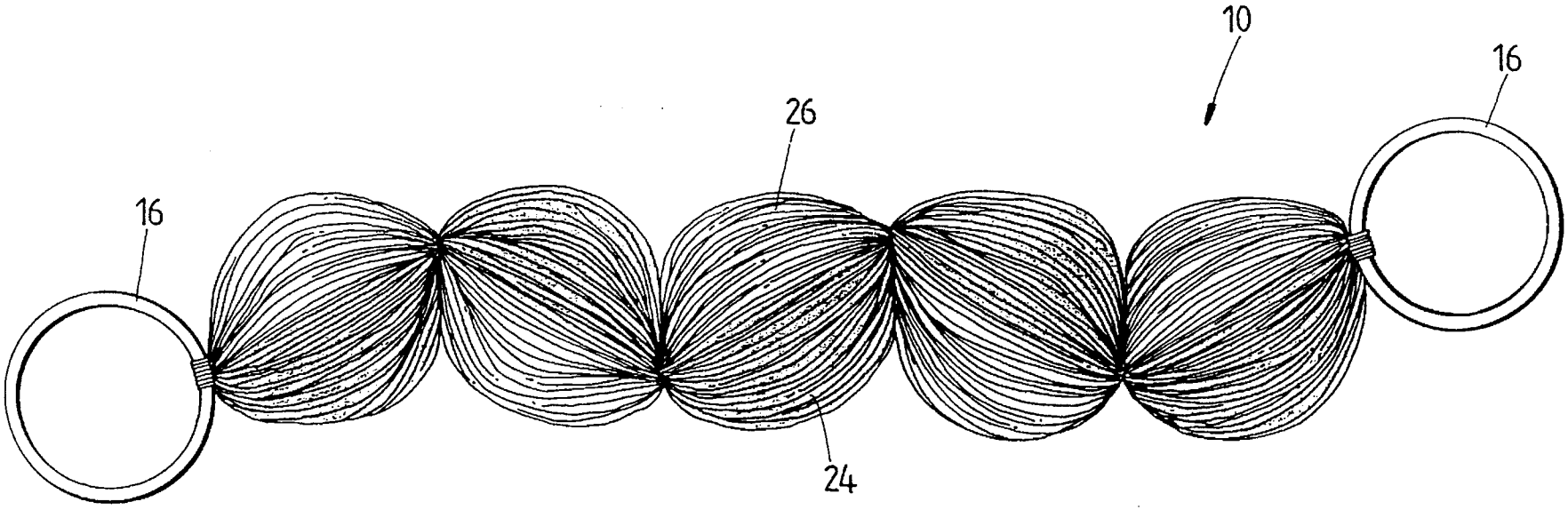
FIG. 6 shows a front view of a fourth preferred embodiment of the present invention.

The fourth preferred embodiment of the present invention is shown in FIG. 6. Each unit member 20 is made up of elastic nets 24 and 26 which are different in color. Before fixing the elastic nets 24 and 26 with the restraining members 14, the left side of the elastic net 24 located at the upper side-of the unit member 20 is pulled downwards while the right side of the elastic net 26 located at the lower side of the unit member 20 is pulled upwards slightly. Such a maneuver as described above can give the main body 12 an added variation in appearance. Each unit member 20 may be made up of a plurality of elastic nets which are fastened in series.

What is claimed is:

1. A beltlike scrubber, which comprises:

a main body made up of a plurality of unit members, with each of said unit members comprising a cylindrical elastic net; and two holding members attached respectively with both ends of said main body;

wherein said unit members are arranged such that two adjoining unit members are fastened in a parallel manner by a restraining member; and wherein said unit members are provided respectively with a pleated outer edge expansible on said restraining member.

2. The beltlike scrubber as defined in claim 1, wherein said unit members are provided respectively with one cylindrical elastic net having a pleated periphery.

3. The beltlike scrubber as defined in claim 1, wherein said unit members are provided respectively with at least two cylindrical elastic nets connected in series.

4. The beltlike scrubber as defined in claim 1, wherein said holding members are of a ring-shaped construction.

5. The beltlike scrubber as defined in claim 1, wherein said holding members are of a handlelike construction.

* * * * *